US007121029B2

(12) United States Patent
Wilson

(10) Patent No.: US 7,121,029 B2
(45) Date of Patent: Oct. 17, 2006

(54) ELEVATED SIGN SYSTEM WITH LOWERING MECHANISM TO ENABLE GROUND LEVEL SERVICING

(76) Inventor: David Wilson, 33 Laurendale Ave., Waterdown, Ontario (CA) L0R 2H0

( * ) Notice: Subject to any disclaimer, the term of this patent is extended or adjusted under 35 U.S.C. 154(b) by 65 days.

(21) Appl. No.: 10/786,020

(22) Filed: Feb. 26, 2004

(65) Prior Publication Data

US 2005/0188571 A1 Sep. 1, 2005

(51) Int. Cl.
*G09F 7/00* (2006.01)

(52) U.S. Cl. ..... 40/601; 40/607.04; 248/333

(58) Field of Classification Search ..... 40/601, 40/607.04, 603, 604, 617; 248/323, 333
See application file for complete search history.

(56) References Cited

U.S. PATENT DOCUMENTS

| | | | | |
|---|---|---|---|---|
| 2,125,994 | A * | 8/1938 | Doering | 40/491 |
| 3,673,720 | A | 7/1972 | Thornton | |
| 3,958,349 | A * | 5/1976 | Nidelkoff | 40/601 |
| 5,072,534 | A | 12/1991 | Kodet | |
| 5,423,142 | A * | 6/1995 | Douglas et al. | 40/605 |
| 5,941,001 | A | 8/1999 | Dietrich et al. | |
| 6,055,754 | A | 5/2000 | Melhuus | |
| 6,148,554 | A | 11/2000 | Dietrich | |
| 6,591,528 | B1 | 7/2003 | Ellingsen | |
| 6,634,610 | B1 | 10/2003 | Ricci et al. | |

* cited by examiner

*Primary Examiner*—Joanne Silbermann
(74) *Attorney, Agent, or Firm*—Robert B. Storey; Bereskin & Parr

(57) ABSTRACT

A sign system is provided. The sign system has a hoisting mechanism for moving a sign between an access or servicing position near ground level and an elevated display position. The sign system includes a first set of guide members and a second set of guide members and a drive system. Each guide member is generally tubular. The guide members of each set are connected together for telescopic movement. Each set of guide members includes an outermost guide member and an innermost guide member, one of which serves as an anchor guide member and the other of which serves as a sign supporting guide member. The sign supporting guide member includes at least one connector for connecting the sign thereto. The anchor guide members of the first and second sets of guide members are fixedly connectable in a generally vertical orientation to a wall or other vertical support means in horizontally spaced relation to each other such that the first and second sets of guide members are extendible downwards to move the sign to the access position and retractable upwards to move the sign to the display position. The drive system is operatively connected to the first and second sets of guide members for selectively moving the first and second sets of guide members between the extended position and the retracted position.

12 Claims, 10 Drawing Sheets

ELEVATED SIGN SYSTEM WITH LOWERING MECHANISM TO ENABLE GROUND LEVEL SERVICING

FIELD OF THE INVENTION

The present invention relates to a sign system for displaying signs or banners at an elevated level.

BACKGROUND OF THE INVENTION

Sign systems for displaying banners are well known. Such sign systems are frequently used by retailers and other commercial establishments to advertise feature products, sales events, and special offers. Banners of this type may be displayed within a commercial establishment, but are also very frequently mounted outside of the commercial establishment, such as high up on an exterior wall where they may be readily viewed at a distance by prospective customers at ground level.

In many such sign installations it is desirable to be able to replace the specific advertising banner frequently, for example to promote seasonal products, or sales events that coincide with various holidays or other special occasions. For signs that are mounted at high levels, this can present a significant challenge. In some cases, the use of portable ladders would be impractical or unsafe, as for example due to inclement weather or excessive height. Fixed ladders may also present a security risk. Specialized mobile elevating equipment may be used to provide access to elevated display signs, but such equipment is very costly.

The object of the present invention is to obviate or mitigate these and other disadvantages of accessing known sign systems for displaying banners.

SUMMARY OF THE INVENTION

The present invention is directed to a sign system having a hoisting mechanism for moving a sign between an access or servicing position near ground level and an elevated display position. The sign system includes a first set of guide members and a second set of guide members and a drive system. Each guide member is generally tubular. The guide members of each set are connected together for telescopic movement. Each set of guide members includes an outermost guide member and an innermost guide member, one of which serves as an anchor guide member and the other of which serves as a sign supporting guide member. The sign supporting guide member includes at least one connector for connecting the sign thereto. The anchor guide members of the first and second sets of guide members are fixedly connectable in a generally vertical orientation to a wall or other vertical support means in horizontally spaced relation to each other such that the first and second sets of guide members are extendible downwards to move the sign to the access position and retractable upwards to move the sign to the display position. The drive system is operatively connected to the first and second sets of guide members for selectively moving the first and second sets of guide members between the extended position and the retracted position.

Preferably, the guide members of each set are slidably connected together. The guide members of each set are generally concentric about a common axis.

Most preferably, the sign includes a top support bar, a bottom support bar and a banner having a top edge and a bottom edge. The banner is connected to the top support bar proximate the top edge of the banner and is connected to the bottom support bar proximate the bottom edge of the banner.

DESCRIPTION OF THE DRAWINGS

For a better understanding of the present invention and to show more clearly how it may be carried into effect, reference will now be made by way of example to the accompanying drawings, in which.

DESCRIPTION OF THE PREFERRED EMBODIMENTS

Figure 1:
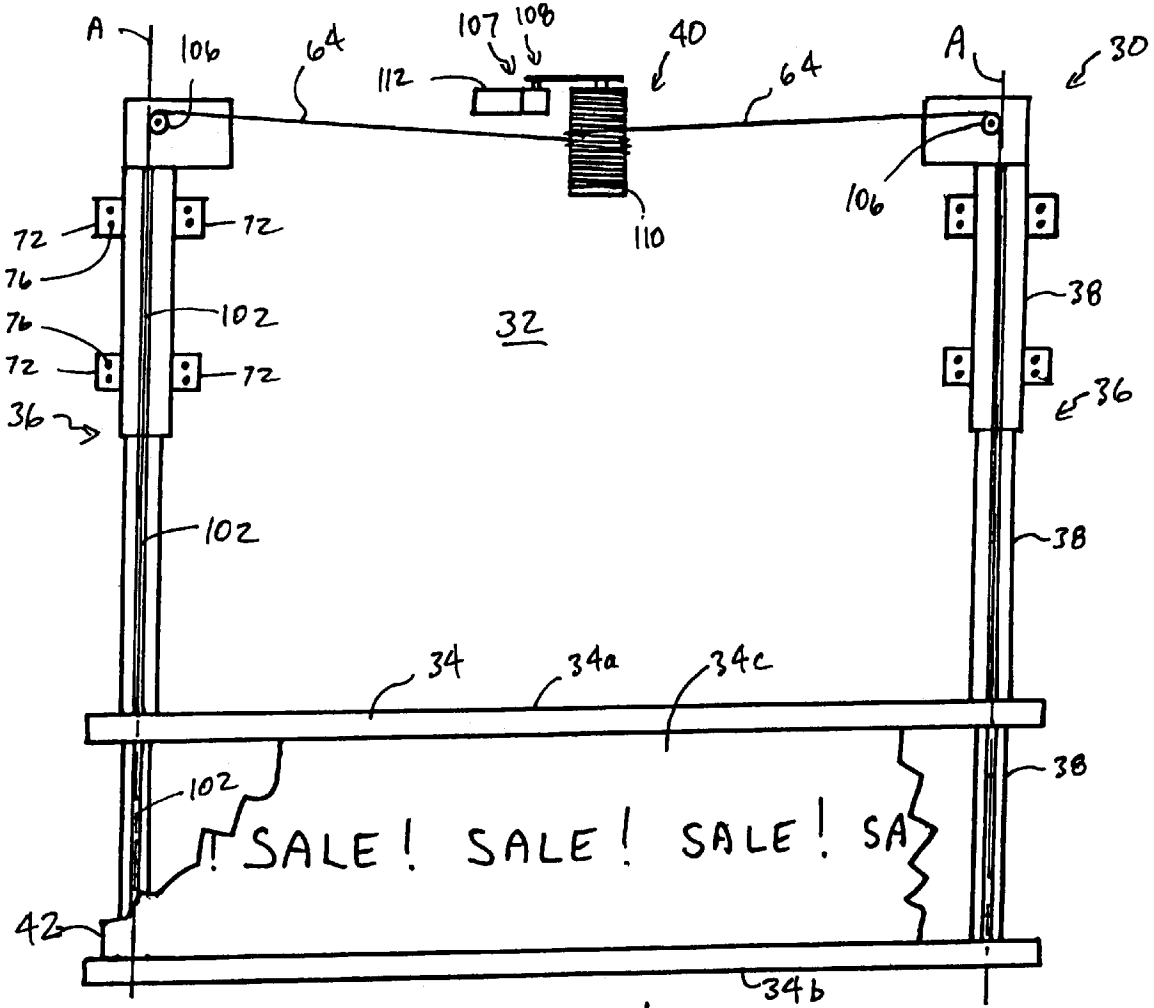
FIG. 1 is an elevation view of a ground accessible sign system in accordance with a first embodiment of the present invention, including a set of guide members which are fully extended, and wherein the sign system is in an access position.
Figure 2:
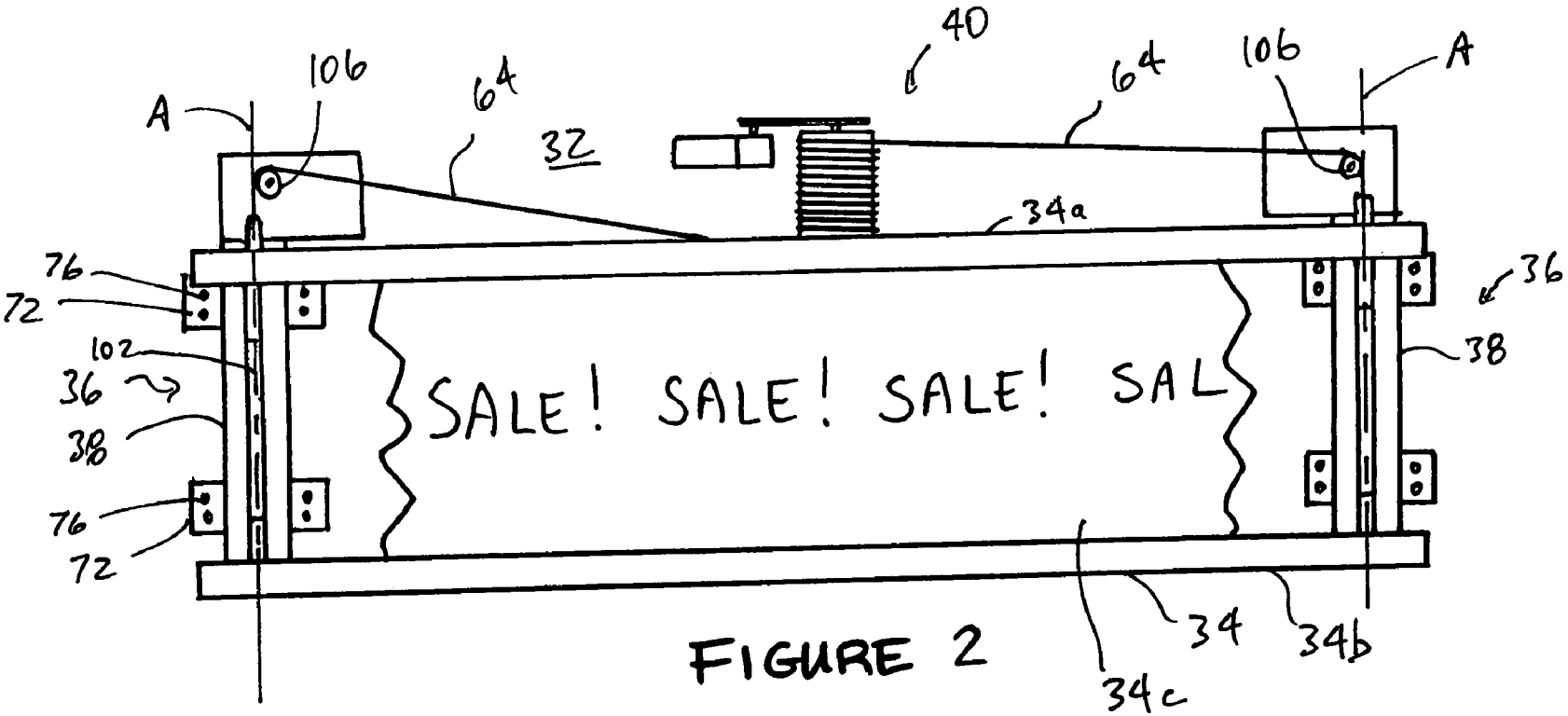
FIG. 2 is an elevation view of the ground accessible sign system shown in FIG. 1, with the guide members fully retracted, wherein the sign system is in a display position.

Reference is made to FIG. 1, which shows a ground accessible sign system 30 in accordance with a first embodiment of the present invention. The ground accessible sign system 30 is mountable to a wall 32, and can be used to move a sign 34 between an access position, which is shown in FIG. 1 and a display position, which is shown in FIG. 2. The sign system 30 is configured to provide a reduced tendency to jam during movement between the access and display positions.

The wall 32 may be any type of surface to which the sign system 30 can be affixed. For example, the wall 32 may be an exterior wall of a building.

The sign 34 may be type of sign known in the art. For example, the sign 34 may include a top support bar 34*a*, a bottom support bar 34*b* and a banner 34*c*. The banner 34*c* may be supported between the top and bottom support bars 34*a* and 34*b*. The banner 34*c* may be made of a tensionable material, such as a canvas backing with a polymeric covering, on which an advertising image may be imprinted.

It will be noted that the term 'bar', in the context of this specification, (eg. the support bars 34*a* and 34*b*), means any suitable support means for supporting the top edge of the banner 34*c*, and is not intended to be limited to solid rods. For example, the support bars 34*a* and 34*b* may be hollow tubes.

The sign system 30 includes two sets 36 of guide members 38, and a drive system 40. The first and second sets 36 of guide members 38 are spaced horizontally from each other, and may, for example, be positioned proximate one of the side edges 42 of the sign 34. The sets 36 of guide members 38 provide a track system permitting the sign 34 to be move to its display and access positions respectively. It is optionally possible to include more than two sets 36 of guide members 38, such as, for example, three or more sets 36 for guiding very wide signs 34.

In the access position (FIG. 1), the sign system 30 is positioned to facilitate access to the sign system 30 for removal or installation of a sign 34 by a worker on the ground. In the display position (FIG. 2), the sign system 30 is positioned to display the sign 34 to passers-by. The display position is elevated relative to the access position.

Figure 5:
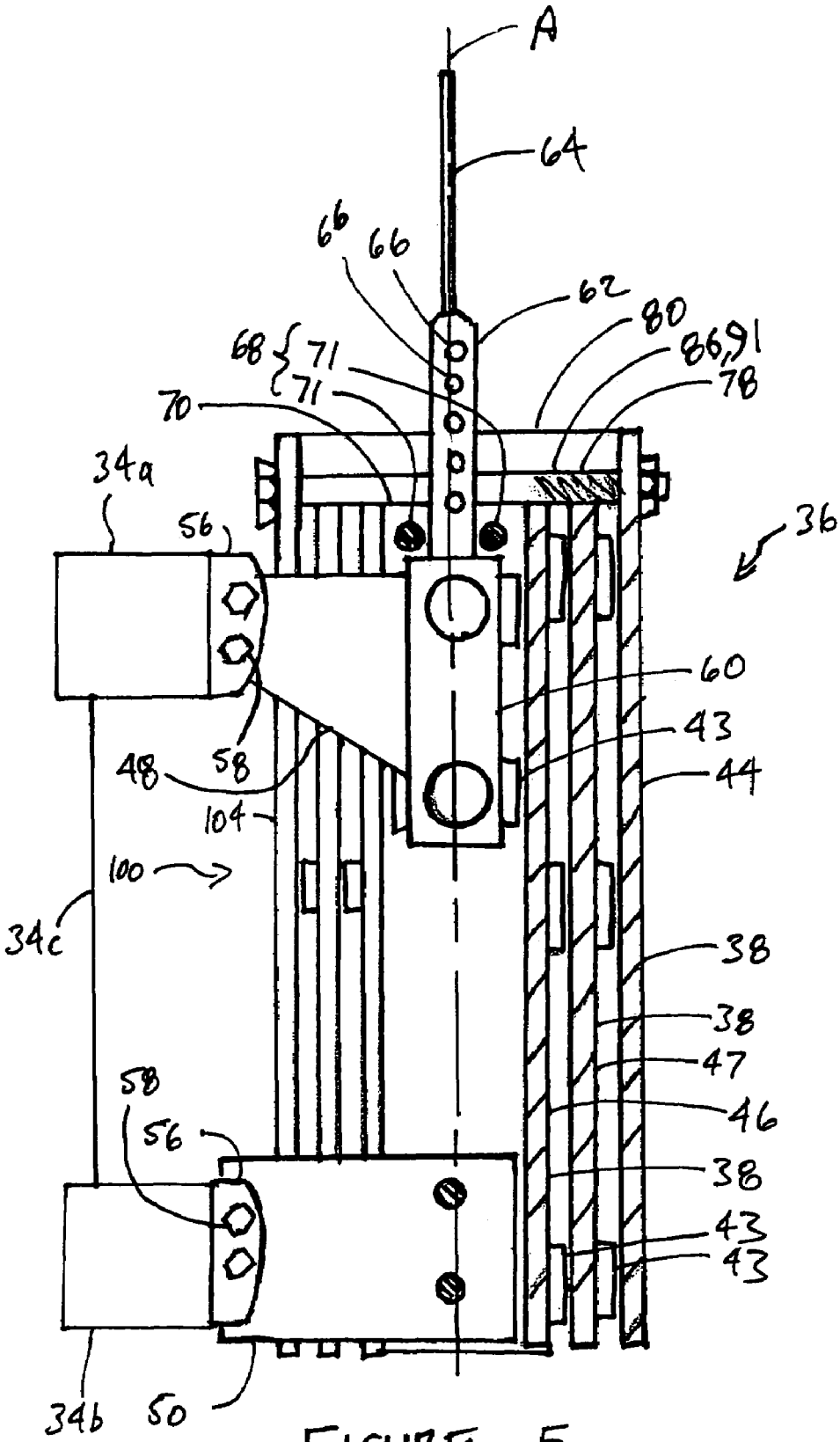
FIG. 5 is a magnified sectional view of one of the sets of guide members shown in FIG. 1, fully retracted.

Reference is now made to FIG. 5, which shows a sectional side view of one of the sets 36 of guide members 38, in a retracted position. The guide members 38 may be generally tubular and may have any suitable cross-sectional shape, such as generally square (see FIG. 7*a*). The guide members 38 may be made from any suitable material, such as aluminum or a steel that is corrosion resistant by means of a coating or by means of its composition (eg. stainless steel).

The guide members 38 may all be generally concentric about a common axis A. It is alternatively possible for one or more of the guide members to be positioned within another guide member 38, but to be configured not to be concentric about the central axis A.

Figure 3:
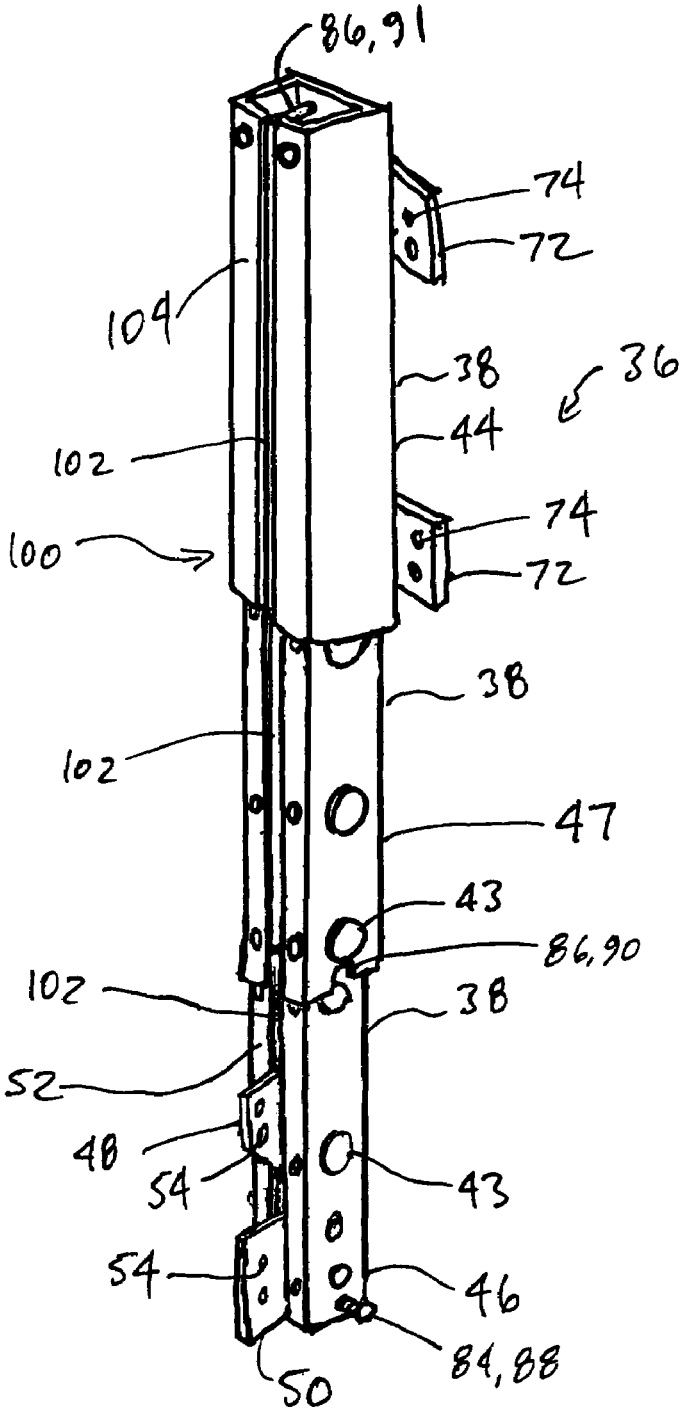
FIG. 3 is a perspective view of one of the sets of guide members shown in FIG. 1, fully extended.
Figure 4:
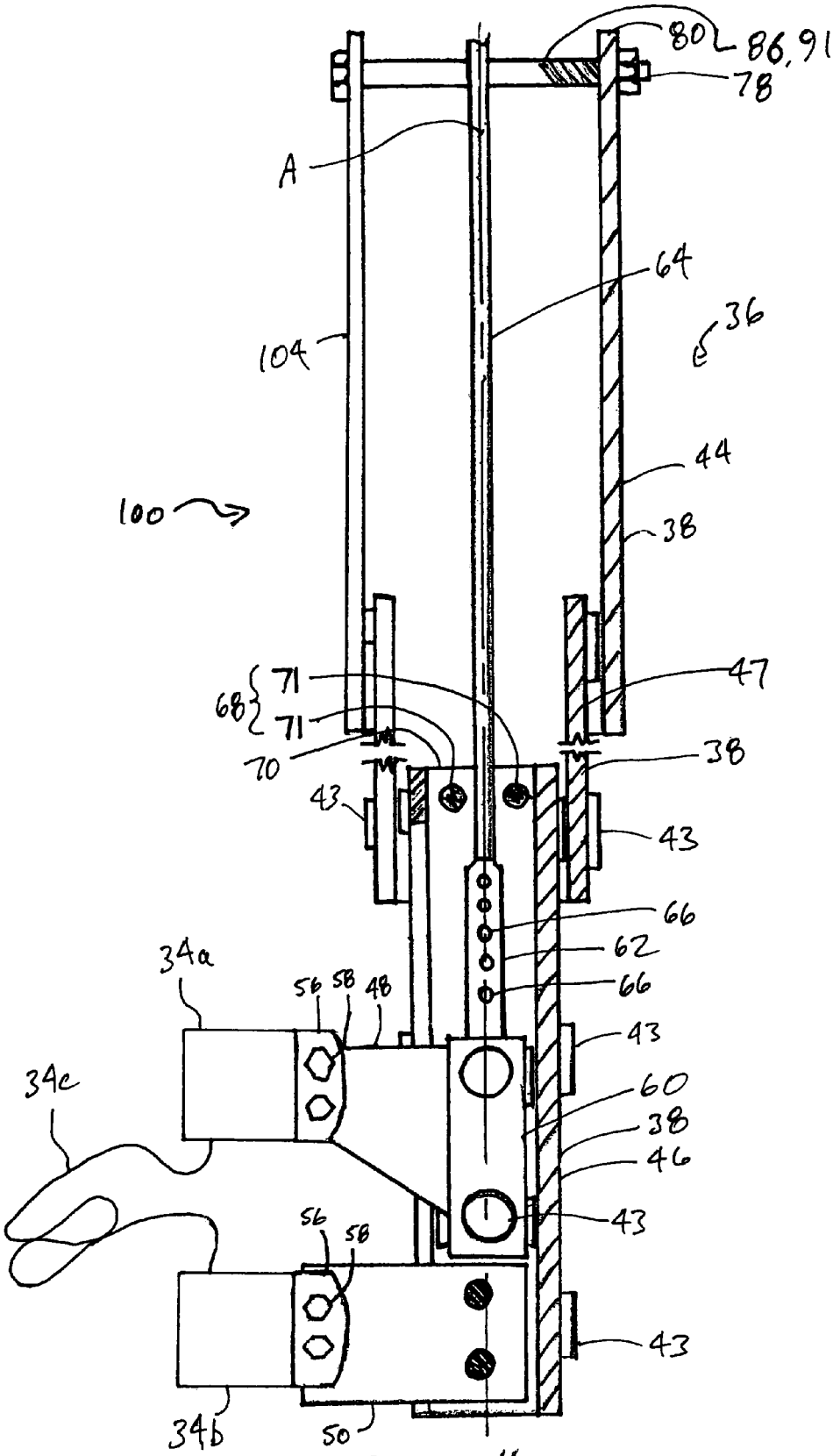
FIG. 4 is a magnified sectional view of one of the sets of guide members shown in FIG. 1, fully extended.

The guide members 38 are slidable within each other, such that each set 36 of guide members 38 can telescope between an extended position, as shown in FIGS. 1, 3 and 4, and a retracted position, as shown in FIGS. 2 and 5.

To reduce the friction during sliding movement between adjacent guide members 38 one or more contact pads 43 may be positioned on the exterior of each guide members 38 as necessary for contacting the inside of the next larger guide member 38. It will be appreciated that contact pads are not necessary for the exterior of the outermost guide member, which is shown at 44. The contact pads 43 may be made from any suitable material, which facilitates sliding contact with the guide members 38. For example, the contact pads 43 may be made from Delrin™. Where a guide member 38 is generally a square or rectangular tube, it is preferable to have contact pads 43 positioned for contacting each face of the inside of the guide member 38.

Each set 36 of guide members 38 includes an innermost guide member 46, the outermost guide member 44, and may further include one or more intermediate guide members 47. In the embodiments shown in the figures, there is one intermediate guide member 47 included on each set 36 of guide members 38.

The innermost guide member 46 is a sign supporting guide member and includes two connectors, namely an upper connector 48 and a lower connector 50, for mounting the sign 34 thereto. More specifically, the top support bar 34*a* may be connected to the upper connector 48 and the bottom support bar 34*b* may be connected to the lower connector 50. It is alternatively possible for more or fewer than two connectors to be included on the innermost guide member 46 for mounting the sign 34 thereto. For example, connector 50 could be omitted from the sign system 30, so that the sign 34 is mounted only to the connector 48 on the innermost guide member 46.

The lower connector 50 may be fixedly connected to the innermost guide member 46 by any means known in the art. For example, the lower connector 50 may be bolted to the guide member 46. As best seen in FIG. 3, the guide member 46 has a front face 52, from which the lower connector 50 extends outwardly.

The lower connector 50 may connect to the bottom support bar 34*b* of the sign 34, by any means known in the art. For example, the lower connector 50 may include two bolt holes 54 (see FIG. 3), which are alignable with bolt holes (not shown) on ears 56 (only one ear 56 is visible on the bottom support bar 34*b* in FIG. 5) that are positioned on the lower support member 34*b*. Fasteners, such as bolts 58 may be secured through the bolt holes 54 in the lower connector 50 and the bolt holes in the ears 56 of the bottom support bar 34*b* to mount the sign 34 to the lower connector 50.

The upper connector 48 is mounted to the innermost guide member 46 and receives the top support bar 34*a* of the sign 34. The upper connector 48 may connect to the top support bar 34*a* of the sign 34, by any means known in the art. For example, the upper connector 48 may include two bolt holes 54 (see FIG. 3), which are alignable with bolt holes (not shown) on ears 56 (only one ear 56 on the top support bar 34*a* is visible in FIG. 5) that are positioned on the upper support bar 34*b*. Fasteners, such as bolts 58 may be secured through the bolt holes 54 in the lower connector 50 and the bolt holes in the ears 56 of the bottom support bar 34*b* to mount the sign 34 to the lower connector 50.

Figure 6:
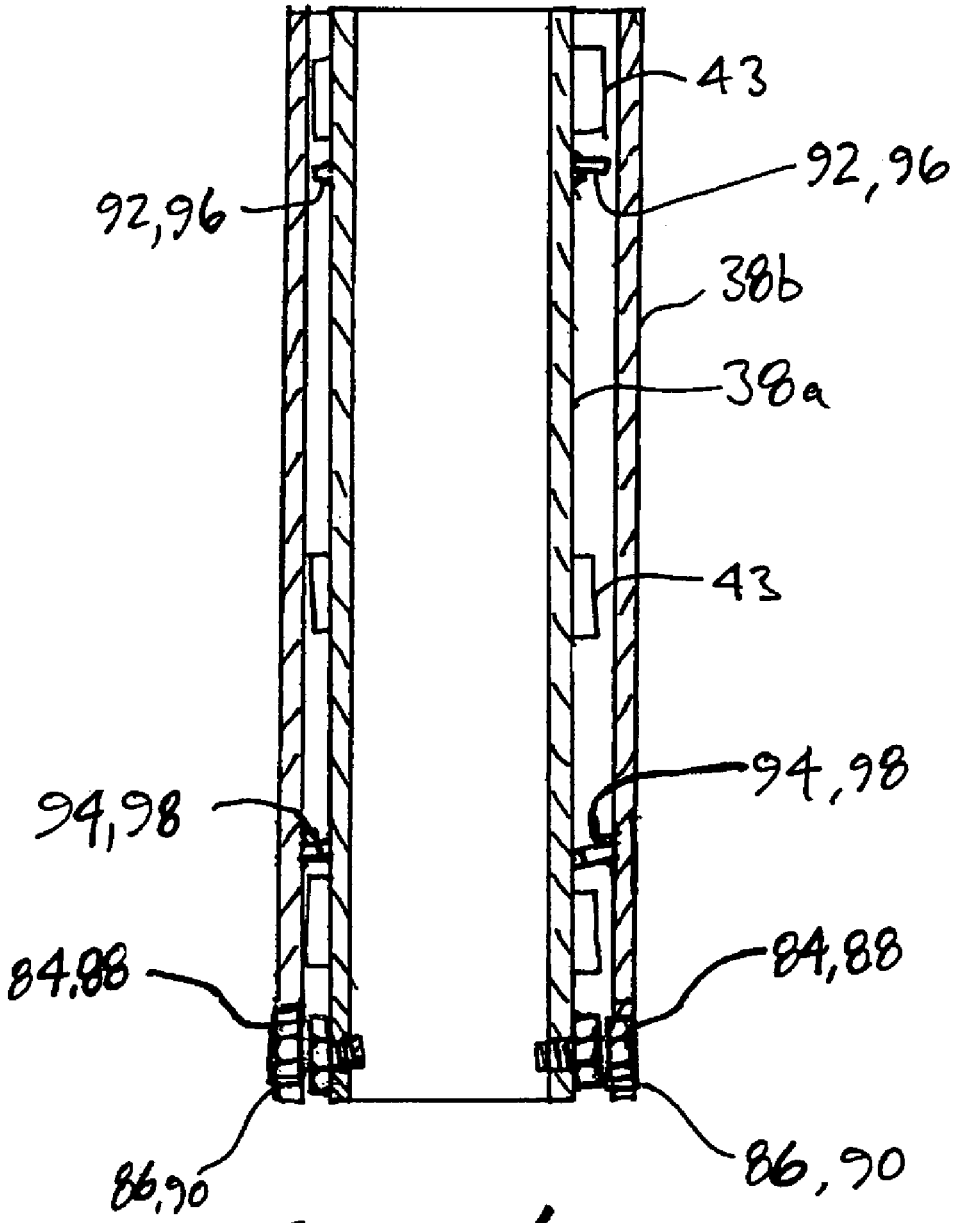
FIG. 6 is a magnified sectional view of two guide members shown in FIG. 1, illustrating engagement of upper limit means.
Figure 7A:
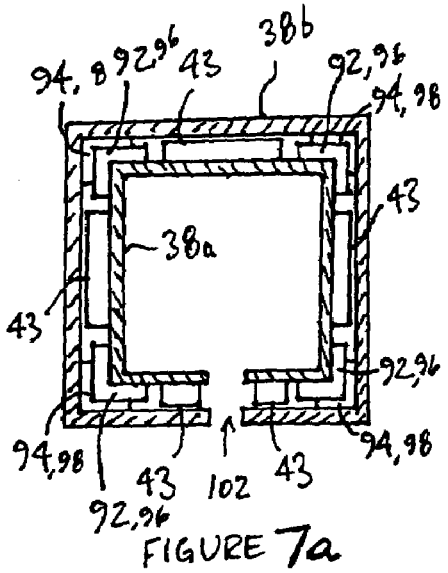
FIGS. 7 and 7*a* are magnified sectional elevation and plan views of two guide members shown in FIG. 1, illustrating engagement of lower limit means.
Figure 7:
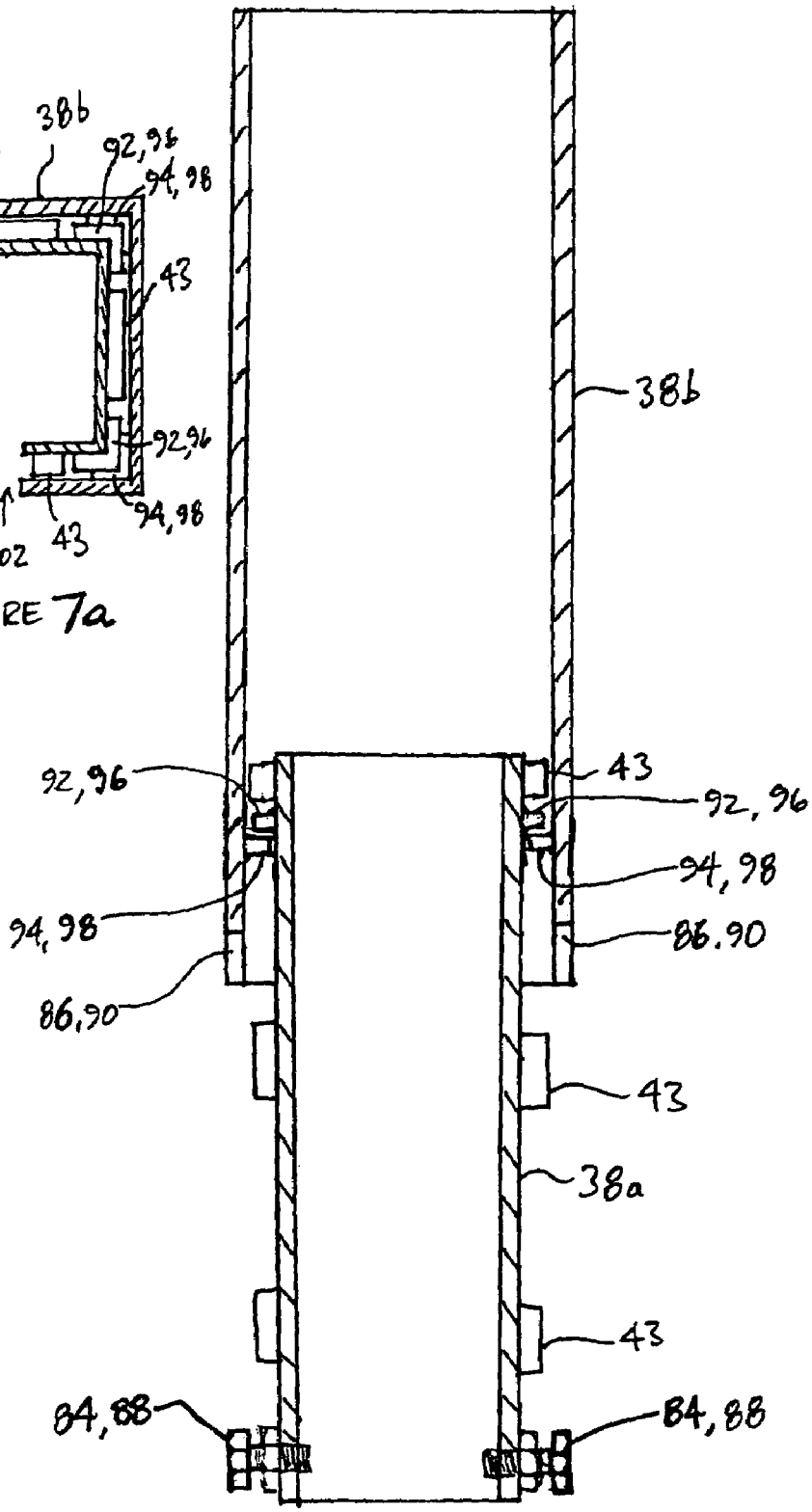

As shown in FIGS. 6 and 7, the upper connector 48 may optionally be slidably mounted to the innermost guide member 46. For example, in embodiments wherein the guide member 46 is tubular, the upper connector 48 may be connected to a slider 60 that is positioned inside the guide member 46.

The slider 60 may be made from a similar material to the guide members 38, such as aluminum or corrosion resistant steel, and may itself be tubular for reduced weight. In order to reduce the friction between the slider 60 and the guide member 46, the slider 60 may include one or more contact pads 43 thereon for contacting the inside of the innermost guide member 46.

Because of the slidable connection between the upper connector 50 and the innermost guide member 46, the upper connector 48 is movable between a tension position, as shown in FIG. 7 for example, and an access position as shown in FIG. 4. In the tension position, the upper connector 48 is spaced sufficiently from the lower connector 50 so that the sign 43 is generally taut between them. In the access position, the upper connector 48 is positioned proximate the lower connector 50. By permitting the upper connector 48 to slide down to an access position proximate the lower connector 50 as shown in FIG. 5, access is facilitated to the upper connector 48 by a worker on the ground during installation or removal of a sign 34. This is particularly useful when using the system 30 with a very tall sign 34 which can be, for example, substantially taller than an average person. In instances where the top of a very tall sign 34 requires accessing and the sign system 30 does not include a sliding upper connector 48, a ladder or other elevating device may be used to elevate a worker to a suitable position for accessing the top of the sign 34.

A cable connector 62 may be connected to the slider 60 to permit connection of a cable 64 thereto. During use, the cable 64 is used to raise and lower the slider 60 between its display position and its access position, and also to raise and lower the sign system 30 between its display and access positions, as is described in more detail further below.

The cable connector 62 may be provided with a plurality of apertures 66, each of which is configured to receive a set screw for retaining the end of the cable 64. The set screws are all tightened against the cable 64 to secure the cable 64 in place in the cable connector 62. Because the set screws may engage the cable 64 at any point, the length of cable 64 that is inserted in the cable connector 62 is adjustable. In other words, there is no single fixed attachment point on the cable 64 for connection to the cable connector 62. This adjustability facilitates making the overall effective lengths match of the two cables 64 that are connected to the two sets 36 of guide members 38, during use. By making the lengths of the cables 64 match each other, the drive system 40 can pull on each set 36 of guide members 38 with generally equal tension in each cable 64.

A stop 68 may be positioned proximate the top end, shown at 70, of the innermost guide member 46. The stop 68 prevents the slider 60 from being pulled farther away from the lower connector 50 than desired during use of the sign system 30. During use, the banner 34*c* of the sign 34 is under tension in the vertical direction, as will be explained in more detail further below. In the event that the banner tears or otherwise fails, the stop 68 acts as a safety device to prevent the slider from being pulled out of the innermost guide member 46. Furthermore, the stop 68 permits the sign system 30 to be retracted even when a sign is not mounted thereon. It is alternatively possible, however, for the stop 68 to be omitted from the innermost guide member 46.

The stop 68 may have any suitable configuration. For example, the stop 68 may be made up of two cross-bars 71 that extend across the inner guide member 46. The two cross-bars 71 may be spaced sufficiently apart to permit the pass-through of the cable 64 and the cable connector 62, but are spaced sufficiently closely to each other to prevent the slider 60 from passing therebetween.

In the embodiment shown in the figures, each outermost guide member 44 is an anchor guide member and fixedly mounts to the wall 32 and thereby acts as an anchor for the rest of the set 36. Referring to FIG. 1, the outermost guide members 44 may include several flanges 72 extending outwardly therefrom with suitably sized bolt holes 74 (see FIG. 3) therethrough for this function. Bolts 76 may be secured into the wall 32 through the bolt holes 74 to complete the mounting of the outermost guide members 44 to the wall 32. It is alternatively possible for the guide members 44 to be mounted in any other suitable way.

Reference is now made to FIGS. 6 and 7. Structure that is incorporated into the guide members to limit their travel relative to each is explained below with reference to an inner guide member 38*a* and an outer guide member 38*b*. The guide members 38*a* and 38*b* may be any two successive guide members in a set 36. Accordingly, the guide members 38*a* and 38*b* directly engage each other slidingly during extension and retraction of the sign system 30.

To set an upper limit of travel of the inner guide member 38*a* with respect to the outer guide member 38*b*, a first upper limit means 84 and a second upper limit means 86 are provided on the inner and outer guide members 38*a* and 38*b* respectively. During retraction of the guide members 38*a* and 38*b*, eg. during raising of the sign 34, the inner guide member 38*a* slides upwards within the outer guide member 38*b*. At a selected point, the first upper limit means 84 on the inner member 38*a* engages the second upper limit means 86 on the outer member 38*b*. As retraction of the guide members 38*a* and 38*b* continues, the inner member 38*a* supports the outer member 38*b* through the engagement of the first and second upper limit means 84 and 86, and the two guide members 38*a* and 38*b* travel together upwards.

Referring to FIG. 1, during retraction of the guide members 38, each guide member 38 slides within and then supports the immediately surrounding guide member 38.

Referring to FIG. 6, the first and second upper limit means 84 and 86 may be provided in any suitable way. For example, the first upper limit means 84 may be provided on a projection 88 mounted at the bottom end of the guide member 38*a*. The projection 88 may comprise, for example, a bolt that is fastened to the wall of the guide member 38*a*, extending outwards therefrom. Preferably, the guide member 38*a* includes a plurality of projections 88 thereon, eg. a projection 88 extending outwards from two opposing walls of each guide member 38.

The second upper limit means 86 may be provided, for example, in a cut-out 90 in the wall of the guide member 38*b*. The cut-out 90 may be generally U-shaped and is configured to receive the projection 88 on the guide member 38*a*.

The first and second upper limit means 84 and 86 may be configured to engage each other after any selected amount of engagement is achieved between the inner and outer guide members 38*a* and 38*b*. For example, they may be configured to engage when the guide members 38*a* and 38*b* are fully engaged whereby their bottom edges are adjacent one another.

Referring to FIG. 5, the second upper limit means on the outermost guide member 44 may comprise a pair of spaced cross-bars 91 that extend across the top of the outer guide member 44. The two cross-bars 91 may be spaced sufficiently apart to permit the pass-through of the cable 64 and the cable connector 62, but are spaced sufficiently closely to each other to prevent the intermediate and innermost guide members 47 and 46 from passing therebetween. The cross-bars 91 may be made up, for example, of bolts that are secured with nuts through the outermost guide member 44.

It is alternatively possible for the second upper limit means 86 on the outermost guide member 44 to comprise the cut-out 90 instead of the cross-bars 91.

Referring to FIG. 6, it will be noted that the outermost guide member 44 does not require a first upper limit means 84 since the outermost guide member 44 does not slide within any surrounding guide member. It will further be appreciated that a second upper limit means 86 need not present on the innermost guide member 46, since no other guide members 38 slide within it.

Reference is now made to FIG. 7. To set a lower limit of travel of the inner guide member 38*a* with respect to the outer guide member 38*b*, a first lower limit means 92 and a second lower limit means 94 are provided on the inner and outer guide members 38*a* and 38*b* respectively. During extension of the guide members 38, eg. during lowering of the sign 34, the inner guide member 38*a* slides downwards within the outer guide member 38*b*. At a selected point, the first lower limit means 92 on the inner member 38*a* engages the second lower limit means 94 on the outer member 38*b*. At this point, the inner guide member 38*a* can lower no further and is then supported by the outer guide member 38*b* through the engagement of the first and second lower limit means 92 and 94. During further extension of a set 36, any guide members (not shown) that are positioned within the inner guide member 38*a* extend downwards relative to the inner guide member 38*a*.

Referring to FIG. 1, as extension of the guide members 38 continues further, each guide member 38 eventually deadends within an immediately surrounding guide member 38 and then is supported by the immediately surrounding guide member 38.

The first and second lower limit means 92 and 94 may be provided by any suitable means. For example, the first lower limit means 92 may be provided on a projection 96 that is fastened to the exterior of each of the guide member 38*a*. The projection 96 may, for example, comprise a plate that is mounted to the exterior of a guide member 38. Alternatively, the projection 96 may, for example, comprise a bolt (not shown) fastened to the wall of the guide member 38 and extending outwards therefrom.

The projection 96 may be mounted at any selected point along the length of each guide member 38. Preferably, two or more projections 96 are positioned on each guide member 38*a*. For example, a projection 96 may be positioned at each corner of the guide member 38*a* at a selected distance from the upper edge of the guide member 38*a* (see FIG. 7*a*).

The second lower limit means 94 may be provided on a projection 98 that extends inwards into the interior of the guide member 38*b*. Preferably, two or more projections 98 are positioned on each guide member 38. For example, a projection 98 may be positioned at each corner of the guide member 38*a* at a selected distance from the lower edge of the guide member 38*b*.

The projection 98 may comprise, for example, a plate, that is mounted in each corner at the bottom of the guide member 38*b* (see FIG. 7*a*). Alternatively, the projection 98 may comprise a bolt (not shown) that is fastened from the outside through the wall of the guide member 38*b* at a suitable position to engage the projection 96 on the guide member 38*a*.

It will be appreciated that the innermost guide member 46 (FIG. 1) does not require a second lower limit means in its interior since there are no guide members that slide within it.

Where contact pads 43 are provided on the exterior of the guide members 38, the projections 98 may be mounted on a guide member 38 in positions suitable so that they do not inadvertently engage a contact pad 43 of the guide member 38 immediately within, during sliding movement between the two guide members 38. As shown in FIG. 7*a*, the projections 98 may be mounted on the corners of the guide member 38*a*, in the case where the contact pads 43 are mounted on the faces of the guide member 38*a*.

In addition to supporting the guide member 38*a* once fully extended within guide member 38*b*, the first and second lower limit means 92 and 94 may be used to ensure that a selected minimum portion of the lengths of the guide members 38*a* and 38*b* remain engaged even when fully extended. To achieve this purpose, the positions of one or both of the lower limit means 92 and 94 may be spaced by a selected amount from the ends of the guide members 38. For example, as shown in FIG. 7, the first lower limit means 92 may be spaced by a first selected amount from the top end of the inner guide members 38*a*, and the position of the second lower limit means 94 may be spaced by a second selected amount from the bottom end of the outer guide member 38*b*. By positioning the first and second lower limit means 92 and 94 in this way, the inner guide member 38*a* remains engaged within the outer guide member 38*b* even at full extension by a minimum length equal to the sum of the selected amounts. Providing a selected minimum length of engagement between the guide members 38*a* and 38*b* reduces the likelihood that the guide members 38 will jam during retraction of the sign system 30.

Referring to FIG. 3, each set 36 of guide members 38 has a front 100. A slot 102 is positioned on at least a portion of the length of each guide member 38 facing the front 84 of the set 36. The slots 102 are all sized to permit the connectors 48 and 50 to pass therethrough, and to permit sliding of the connectors 48 and 50 during movement of the sign system 30.

Referring to FIG. 5, it will be appreciated that the connectors 48 and 50 extend sufficiently far out frontwardly from the innermost guide member 46 that the bolt holes 54 remain outside beyond the plane of the front surface, which is shown at 104, on the outermost guide member 44. This is so that the sign 34 may be connected to the connectors 48 and 50 throughout the range of motion of the sign system 30.

As explained above, throughout the range of motion of the sign system 30, a portion of the length of each guide member 38 remains inserted within the immediately surrounding guide member 38. Accordingly, the slot 102 may be omitted from a portion of the length proximate the top of each of the guide members 38, ie. along a portion of the guide members 38 never traveled by the connector 48 during retraction or extension of the sign system 30.

The slot 102 may be omitted entirely from the innermost guide member 46 in embodiments wherein the sliding upper connector 48 is replaced by a fixed connector.

Referring to FIG. 1, the drive system 40 includes a cable 64 for each set 36 of guide members 38, and further includes a pulley 106 for each cable 64. Each pulley 106 is fixedly mounted to the wall 32 and is positioned above a set 36 of guide members 38 such that the cable 64 extends up from the set 36 substantially vertically and is received tangentially on the pulley 106. The cable 64 passes over the pulley 106 and extends to a drive means 107, which may be any suitable drive means known in the art.

To raise the sign system 30 from the access position shown in FIG. 1 to the display position shown in FIG. 2, the two cables 64 are pulled. By virtue of the positioning of the pulleys 106 the cables 64 remain substantially vertical throughout the range of motion of the sign system 30. By having the cables 64 remain vertical, the force transmitted by the cables 64 to the guide members 38 is always vertical.

Preferably, the drive system 40 is further configured, as shown in FIGS. 1 and 2, so that the cables 64 exert forces on the guide members 38 along a line of direction that is vertical and that is within the contained volume of all of the guide members 38. This is different from some sign system of the prior art, which provide lifting forces that are always substantially offset from the axis of travel of their guide members. The offset lifting forces that are exerted in such prior art systems, impart moments on some guide members relative to other guide members, thereby tending to angle some guide members as much as is permitted by the play between their respective interengaging portions. This tendency to angle the guide members relative to each other in systems of the prior art can increase the risk of jamming of the guide members during extension or retraction of the guide members.

Providing the preferred configuration shown most clearly in FIGS. 6 and 7 substantially reduces any moments imparted on the guide members 38 during retraction and extension of the guide members 38. Accordingly, the reduction in rotational forces imparted to the guide members 38 reduces the tendency of the guide members 38 to jam during extension or retraction.

It is further preferable for the drive system 40 to be configured, as shown in FIGS. 6 and 7, so that the cables 64 exert forces on the guide members 38 along a line of direction that is vertical and that is coaxial with the centerline axis A of all of the guide members 38. Providing this further preferred configuration, substantially eliminates any moments imparted by the cables 64 to the guide members 38 during retraction or extension of the guide members 38. Accordingly, the reduction in moments imparted to the guide members 38 further reduces the tendency of the guide members 38 to jam during extension or retraction.

A winch 108 may optionally make up the drive means 107, to facilitate raising and lowering the sign system 30. The winch 108 includes a winch drum 110 to which one end of each of the cables 64 may be connected.

The winch drum 110 may be oriented in any suitable way for receiving the cables 64. Preferably, the winch drum 110 extends vertically on the wall 32. It is alternatively possible for the winch drum 110 to be oriented generally outwards from the wall 32, and may generally be oriented in any way, wherein the drum axis of rotation lies in a plane that is vertical and perpendicular to the wall 32.

The winch 108 is rotatable in both directions so that cable 64 may be wound onto the winch drum 110, or unwound from the winch drum 110 as desired for raising or lowering the sign system 30. In the embodiment shown in the figures, the winch drum 110 receives both cables 64. Because the cables 64 extend off from the winch drum 110 in opposite directions to each other, the cables 64 depart from the drum surface 180 degrees apart circumferentially.

It is alternatively possible for both cables 64 to depart from the drum 110 in the same direction, and thus be circumferentially in phase with each other. In this alternative, the drive system 40 could include a series of pulleys to guide one of the cables 64 over to the pulley 106 above its associated set 36 of the guide members 38.

The winch 108 may be motorized, and may thus include a drive motor 112. The drive motor 112 is preferably capable of rotation in either direction for raising or lowering the sign system 30 between its display and access positions.

Suitable control means (not shown) are preferably provided for control of the operation of the winch 108 (or other drive means 107) at ground level.

It is alternatively possible for the winch 108 to be manually powered, and to include a crank for manual operation by a worker. In this case, it is preferable for the winch 108 to be positioned near ground level at a height that facilitates cranking by a worker.

The use of the sign system 30 will be described with respect to the embodiment shown in FIGS. 1 and 2. In use, a sign 34 may be mounted to the sign system 30 if the sign system 30 is in the access position as shown in FIG. 1. In the access position, the guide members 38 are extended so that at least the lower connectors 50 are proximate the ground. If the upper connectors 48 are slidable within the innermost guide member 44, then the upper connectors 48 may also be positioned proximate the ground. The sign 34 may be mounted to the upper and lower connectors 48 and 50. To facilitate installation of the sign, the top support bar 34*a* may be mounted to the upper connector 48 first, and then the upper connector 48 may be raised to a suitable height by the drive system 40, so that the banner 34*c* does not obstruct access to the lower connector 50.

Once the sign 34 is mounted, the upper connector 48 may be raised further. At some point in its upwards travel, the banner 34*c* becomes taut and the lifting force being exerted on the upper connector 48 is transmitted through the sign 34 to the lower connector 50, which is fixedly connected to the innermost guide member 46. Further raising of the upper connector 48 then raises the lower connector 50 and the innermost guide member 46. During this stage, the sign 34 is lifted up along with the innermost guide member 46. Also, during this stage and thereafter throughout the retracting of the guide members towards the display position, the sign 34 remains supported from its top support bar 34*a*, and remains taut from its own weight. As the innermost guide member 46 rises it slidably engages the immediately surrounding guide member, which may be an intermediate guide member 47, as is the case for the embodiment shown in FIG. 1. As the innermost member 46 rises further, the first upper limit means 84 on it will engage the second upper limit means 86 on the intermediate member 47. At that point, continued raising of the innermost member 46 will also raise the intermediate member 47. In embodiments where several intermediate members 47 provided are provided, further drawing up of the cables 64 causes each guide member 38 to engage the next successively larger guide member 38 until all of the intermediate and innermost guide members 47 and 46 are retracted into the outermost guide member 44. At that point, the sign 34 is at its display height. At this point, the sign system 30 appears as illustrated in FIG. 2.

During lowering of the sign system 30 from the display position (see FIG. 2), the cables 64 are let out. At that point, all the guide members 38 inside the outermost guide member 44 are lowered together en masse with the first and second engagement surfaces remaining engaged with each other. As the guide members 38 are lowered the second lower limit means 94 on the outermost guide member 44 engages the first lower limit means 92 on the next successively smaller guide member 38, which may be, for example, an intermediate guide member 47, as shown in FIG. 5. At this point, the intermediate guide member 47 remains supported by the outermost guide member 44 and further letting out of the cables 64 lowers any remaining guide members 38. As the cables 64 are let out each guide member 38 eventually engages and remains supported by the guide member 38 immediately larger that it until all of the guide members 38 are extended. At this point the sign system 30 is in the access position.

At this point, if the sign system includes sliding upper connectors 48, further letting out of cables 64 lowers the upper connectors 48 towards the lower connectors 50 within the innermost guide members 46. At this point, the sign 34 is no longer taut and may be removed from the upper and lower connectors 48 and 50.

The sign system 30, once installed, may be modified to accommodate a wider sign 34 than it was installed for, by repositioning one or both of the sets 36 of guide member 38 to be farther apart on the wall 32. Additionally, the winch drum 110 may require repositioning depending on how much extra cable 64 it can accommodate. The cables 64 may require replacement with longer cables 64.

Furthermore, the sign system 30 may include as many successively larger guide members 38 as necessary to accommodate the overall height difference between the display and access positions. For situations where the sign is displayed at a relatively high position, rollers (not shown) may be provided at spaced intervals as necessary on the wall to assist in guiding the sign system 30 during extension and retraction of the guide members 38.

Figure 8A:
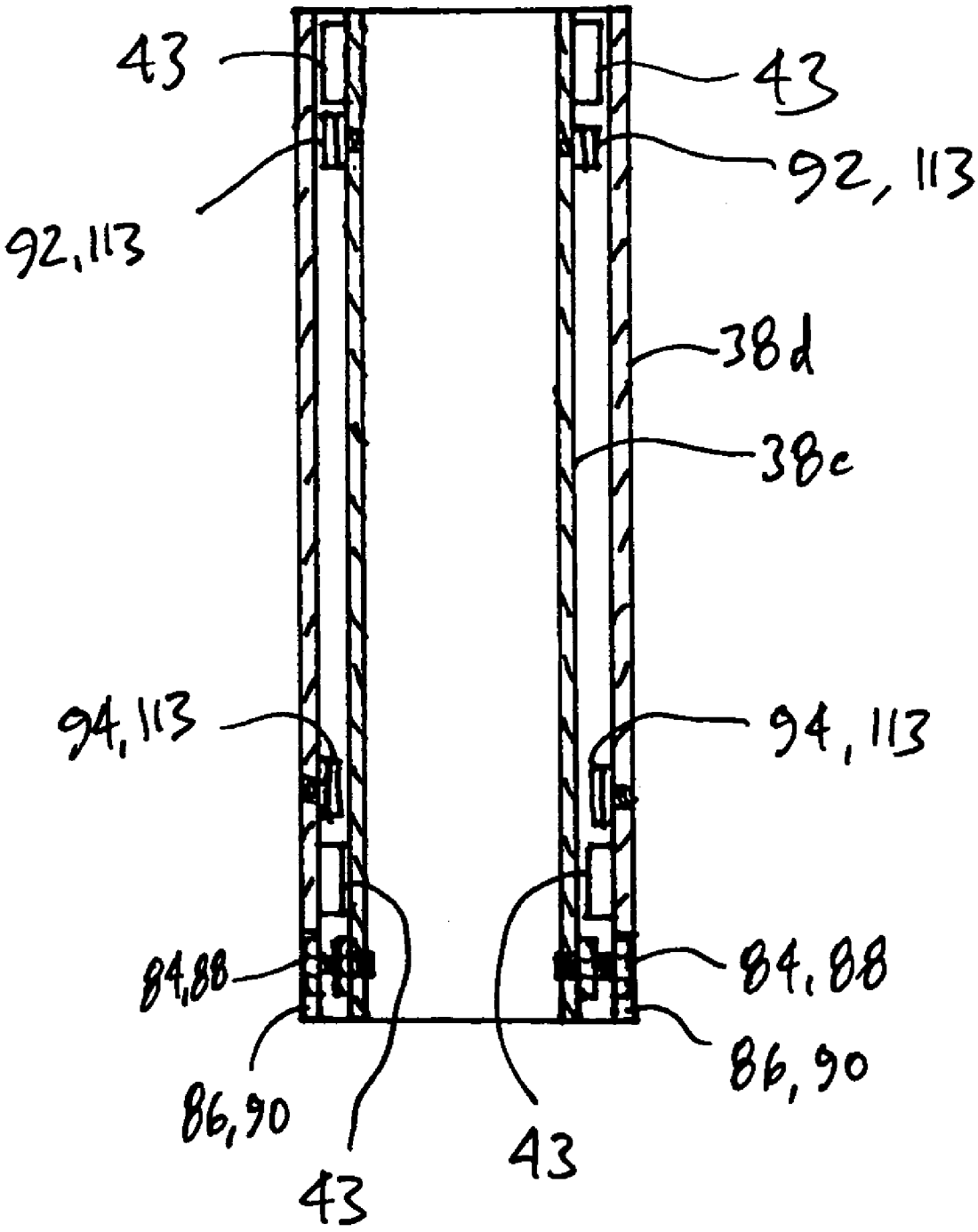
FIGS. 8*a* and 8*b* are magnified sectional views of two guide members shown in FIG. 1, in the extended and retracted positions respectively, showing an alternative configuration of contact pads and lower limit means.
Figure 8B:
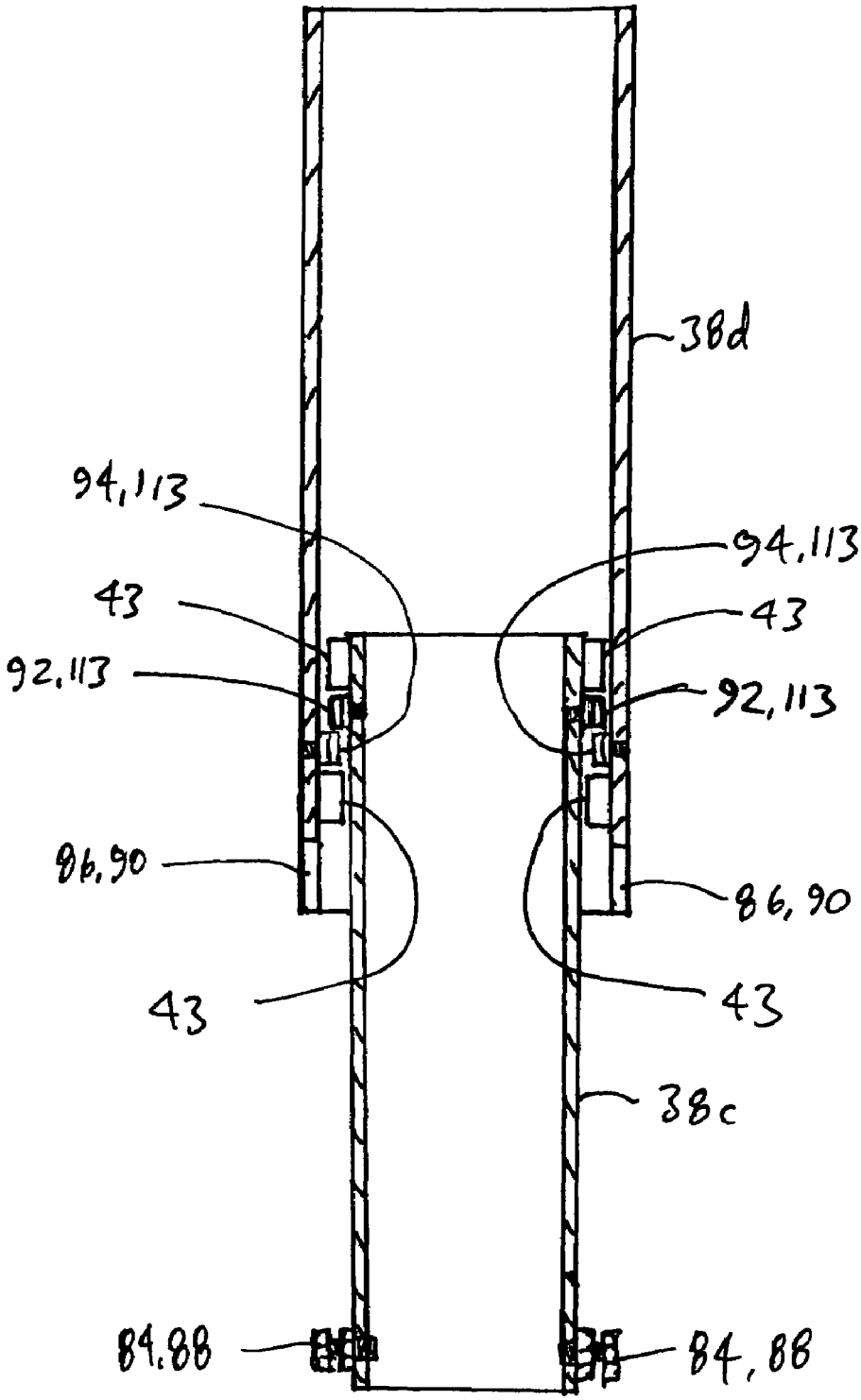

Reference is now made to FIGS. 8*a* and 8*b*, which show two guide members 38*c* and 38*d* in the retracted and extended positions with an alternative configuration for the contact pads 43 and for the first and second lower limit means 92 and 94. In this alternative configuration there is a contact pad 43 on each face of the exterior proximate the top end of the inner guide member 38*c*. At some point below the positions of the contact pads 43, is positioned the first lower limit means 92 which may include, for example, several bolts 113. The bolts 113 may be positioned on each exterior face of the inner guide member 38*c*.

The outer guide member 38*d* has a contact pad 43 on each face of the interior proximate the bottom end. At some point above the position of the contact pads 43 is positioned the second lower limit means 94, which may include, for example, several bolts 113. The bolts 113 may be positioned on each interior face of the outer guide member 38*d* for engagement with the bolts 113 on the inner guide member 38*c* when the inner guide member 38*c* reaches its extended position (see FIG. 8*b*).

It is alternatively possible for a single bolt 113 to be mounted on each of the exterior of the inner guide member 38*c* and the interior of the outer guide member 38*d*, since in the configuration shown in FIGS. 8*a* and 8*b*, the bolts 113 will only be required to support the weight of the guide member 38*c*.

As can be seen in FIGS. 8*a* and 8*b*, the inner and outer guide members 38*c* and 38*d* engage each other with both sets of contact pads 43 throughout their range of motion. Furthermore, when the guide member 38 is extended to the position shown in FIG. 8*b*, none of the contact pads 43 are exposed, which provided a cleaner appearance. Furthermore, with this configuration, there is no risk of a situation where a contact pad jams as it enters engagement with a guide member, because the contact pads 43 are always in engagement with the guide members 38*c* and 38*d* throughout the range of motion of the guide members 38*c* and 38*d*.

Furthermore, in this configuration, the first and second lower limit means 92 and 94 may be positioned anywhere suitable around the perimeter of the guide members 38*c* and 38*d*, without concern for inadvertently contacting a contact pad 43.

Similarly to the embodiment shown in FIG. 7, the positions of the first and second lower limit means 92 and 94 impact the amount of engagement that exists between the guide members 38*c* and 38*d* when in the extended position as shown in FIG. 8*b*.

Figure 9A:
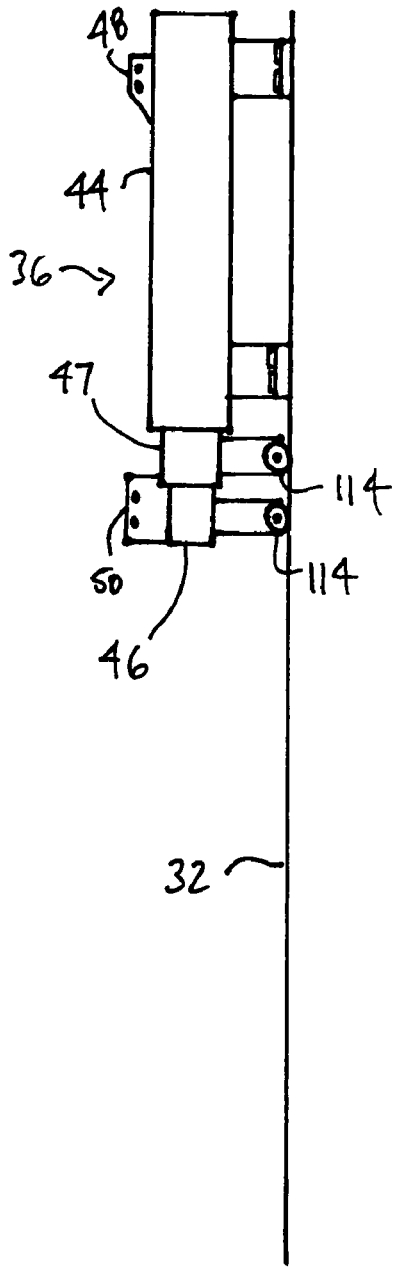
FIG. 9*a* is a side view of one of the sets of guide members shown in FIG. 1, in a retracted position, with an optional wheel connected thereto.
Figure 9B:
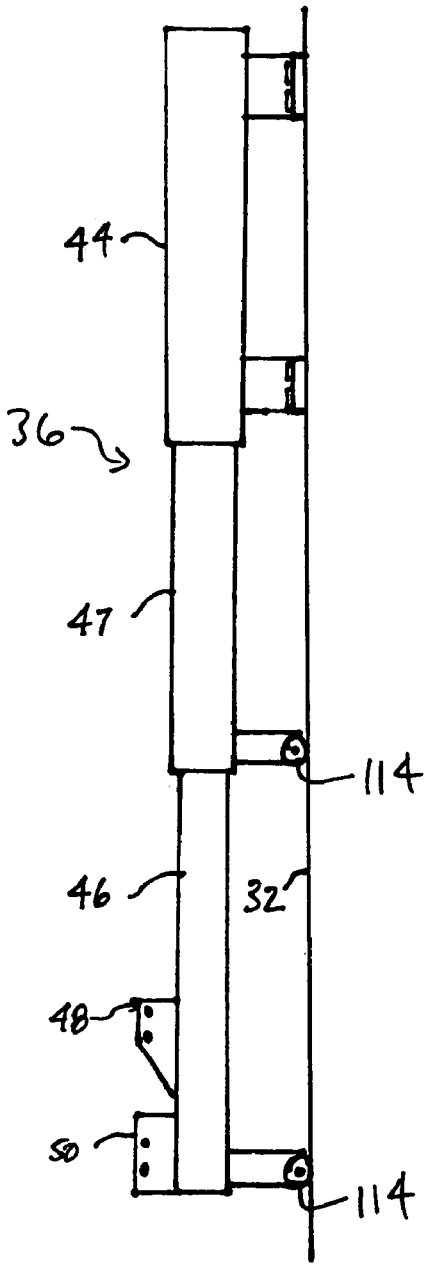
FIG. 9*b* is a side view of the set of guide members shown in FIG. 9*b*, in an extended position, with an optional wheel connected thereto.

Reference is now made to FIGS. 9*a* and 9*b*. For very tall signs, one or more of the guide members 38 may include a wheel 114 connected thereto for engaging the wall 32 as the sign system 30 is lowered and raised. In FIG. 9*a*, the set 36 is shown in the retracted position, and in FIG. 9*b*, the set 36 is shown in the extended position. By engaging the wall 32 during movement of the sign system 30, the wheels 114 provide increased stability to the system 30, particularly during the portions of its travel wherein the sets 36 of guide members 38 approach their extended positions (see FIG. 9*b*). In an alternative embodiment that is not shown, it is possible for the one or more wheels 114 to be positioned on the wall 32 instead of being positioned on the guide members 38. By positioning the wheels 114 on the wall, the guide members 38 can more easily be configured to retract fully within each other.

The sign 34 has been described as being a banner 34*c* that is tensioned by gravity between a top support bar 34*a* and the bottom support bar 34*b*. It is alternatively possible for the sign to have a fixed frame including top and bottom support bars and vertically extending side support bars. Furthermore, the banner portion of the sign need not be flexible, but could instead be made from a rigid or semi-rigid material. In these alternative, a sliding upper connector may be omitted on the innermost guide member 46. Instead, a fixed upper connector could be used. Furthermore, a single connector could be provided to replace both the fixed upper and lower connectors to support a sign with a fixed frame. It will be appreciated that in embodiments wherein a sliding upper connector is not provided in the innermost guide member 46, a stop is not required in the innermost guide member 46. Accordingly, the sign system 30 may include at least one connector depending in part on the configuration of the sign being supported.

The sets 36 of guide members 38 have been described as having an outermost guide member 44 that is fixed to the wall 32, and an innermost guide member 46 to which the sign 34 is connected. It is alternatively possible for the sign system to have an innermost guide member that is affixed to a wall, and to have successively larger guide members telescope downwards, ending at an outermost guide member to which the sign may be attached.

The system of the present invention may be used to access signs for replacement of the banner or replacement of the entire sign. Also, the system of the present invention may be used for accessing a sign so that it may be washed, repainted or otherwise serviced. In either case, the sign may have a flexible banner, or a rigid or semi-rigid banner, which may or may not be intended for regular replacement.

While the above description constitutes the preferred embodiments, it will be appreciated that the present invention is susceptible to modification and change without departing from the fair meaning of the accompanying claims.

The invention claimed is:

1. A sign system for moving a sign on a vertical support means between an access position and a display position which is higher than the access position, the sign system comprising:

a first set and a second set of generally tubular guide members connected together for telescopic movement;

each said set of guide members including an outermost guide member, and an innermost guide member, one of said outermost and said innermost guide members being an anchor guide member and other of said outermost and said innermost guide members being a sign supporting guide member;

said sign supporting guide member including at least one connector for connecting said sign thereto;

said anchor guide members of said first and second sets of guide members being fixedly connectable in a generally vertical orientation to the vertical support means in horizontally spaced relation to each other such that said first and second sets of guide members are extendible downwards to move said sign to said access position and retractable upwards to move said sign to said display position; and a drive system operatively connected to said first and second sets of guide members for selectively moving said first and second sets of guide members between said extended position and said retracted position, wherein said anchor guide member is said outermost guide member, and wherein said vertical support means is a wall, and wherein said drive system includes a first cable and a second cable, wherein said first and second cables are connected to said sign supporting guide members of said first and second sets of guide members, and wherein, in use, said first and second cables extend substantially vertically upwards from said sign supporting guide members during retraction and extension of said set of guide members, and wherein said sign includes a too support bar, a bottom support bar and a banner having a top edge and a bottom edge, and wherein said banner is connected to said top support bar proximate said top edge of said banner and is connected to said bottom support bar proximate said bottom edge of said banner, and wherein each said sign supporting guide member includes an upper connector for connecting to said top support bar and a lower connector for connecting to said bottom support bar, and wherein said top and bottom support bars are movable towards each other, and wherein said upper connector is slidably connected to said sign supporting guide member for movement towards and away from said lower connector, and wherein each said cable is connected to said upper connector so that when said cables are pulled upwards to retract said set of guide members said upper connector is pulled upwards away from said lower connector.

2. A sign system as claimed in claim 1, wherein said drive system further includes a pulley positioned above each said set of guide members, wherein said cable for each said set of guide members passes over said pulley.

3. A sign system as claimed in claim 2, wherein said first and second cables are connected to a winch, wherein said winch is selectively rotatable in a first direction to wind said cables up thereon to retract said first and second set of guide members, and wherein said winch is selectively rotatable in a second direction to unwind said cables therefrom to permit said sign to lower under the influence of gravity.

4. A sign system as claimed in claim 1, wherein in said retracted position, said first and second sets of guide members have a height that is less than or generally equal to the height of said sign.

5. A sign system as claimed in claim 1, wherein a wheel is connectable to one of said wall and at least one guide member in each said set, wherein said wheel is rotatable against said other one of said wall and at least one guide member during extension and retraction of said sets of guide members, and wherein when each said set of guide members is in said extended position, said wheel is spaced from said anchor guide member for stabilizing said sets of guide members.

6. A sign system for moving a sign on a vertical support means between an access position and a display position which is higher than the access position, the sign system comprising:

a first set and a second set of generally tubular guide members connected together for telescopic movement;

each said set of guide members including an outermost guide member, and an innermost guide member, one of said outermost and said innermost guide members being an anchor guide member and other of said outermost and said innermost guide members being a sign supporting guide member;

said sign supporting guide member including at least one connector for connecting said sign thereto;

said anchor guide members of said first and second sets of guide members being fixedly connectable in a generally vertical orientation to the vertical support means in horizontally spaced relation to each other such that said first and second sets of guide members are extendible downwards to move said sign to said access position and retractable upwards to move said sign to said display position; and a drive system operatively connected to said first and second sets of guide members for selectively moving said first and second sets of guide members between said extended position and said retracted position, wherein said anchor guide member is said outermost guide member, and wherein said vertical support means is a wall, and wherein said drive system includes a first cable and a second cable, wherein said first and second cables are connected to said sign supporting guide members of said first and second sets of guide members, and wherein, in use, said first and second cables extend substantially vertically upwards from said sign supporting guide members during retraction and extension of said set of guide members, and wherein said sign includes a top support bar, a bottom support bar and a banner having a top edge and a bottom edge, and wherein said banner is connected to said top support bar proximate said top edge of said banner and is connected to said bottom support bar proximate said bottom edge of said banner, and wherein each said sign supporting guide member includes an upper connector for connecting to said top support bar and a lower connector for connecting to said bottom support bar.

and wherein said sign is unsupported against movement of said top and bottom support bars towards each other, and wherein said upper connector is slidably connected to said sign supporting guide member for movement towards and away from said lower connector, and wherein said drive system is operatively connected to said upper connector wherein said drive system is configured to selectively move said upper connector into spaced relation with said lower connector.

7. A ground accessible sign system for moving a sign between an access position and a display position which is higher than the access position, the ground accessible sign system comprising:

a first set of guide members and a second set of guide members, wherein each set of guide members are slidably connected together, and wherein the guide members of each set are generally concentric about a common axis, wherein each set of guide members includes an outermost guide member, an innermost guide member, and wherein one of the outermost and innermost guide members is an anchor guide member and the other of the outermost and innermost guide members is a sign supporting guide member, and wherein the sign supporting guide member includes at least one connector for connecting the sign thereto, wherein the anchor guide members of the first and second sets of guide members are fixedly connectable in a generally vertical orientation to a wall in horizontally spaced relation to each other such that the first and second sets of guide members are extendible downwards to move the sign to the access position and retractable upwards to move the sign to the display position; and a drive system operatively connected to the first and second sets of guide members for selectively moving the first and second sets of guide members between the extended position and the retracted position, wherein the anchor guide member is the outermost guide member, and wherein the drive system includes a first cable and a second cable, wherein the first and second cables are connected to the sign supporting guide members of the first and second sets of guide members, and wherein, in use, the first and second cables extend substantially vertically upwards from the sign supporting guide members during retraction and extension of the set of guide members, and wherein the sign includes a top support bar, a bottom support bar and a banner having a top edge and a bottom edge, and wherein the banner is connected to the tap support bar proximate the top edge of the banner and is connected to the bottom support bar proximate the bottom edge of the banner, and wherein each sign supporting guide member includes an upper connector for connecting to the top support bar and a lower connector for connecting to the bottom support bar, and wherein the top and bottom support bars are movable towards each other, and wherein the upper connector is slidably connected to the sign supporting guide member for movement towards and away from the lower connector, and wherein each cable is connected to the upper connector so that when the cables are pulled upwards to retract the set of guide members the upper connector is pulled upwards away from the lower connector.

8. A ground accessible sign system as claimed in claim 7, wherein the drive system further includes a pulley positioned above each set of guide members, wherein the cable for each set of guide members passes over the pulley.

9. A ground accessible sign system as claimed in claim 8, wherein the first and second cables are connected to a winch, wherein the winch is selectively rotatable in a first direction to wind the cables up thereon to retract the first and second set of guide members, and wherein the winch is selectively rotatable in a second direction to unwind the cables therefrom to permit the sign to lower under the influence of gravity.

10. A ground accessible sign system as claimed in claim 7, wherein the sign is unsupported against movement of the top and bottom support bars towards each other, and wherein the upper connector is slidably connected to the sign supporting guide member for movement towards and away from the lower connector, and wherein the drive system is operatively connected to the upper connector wherein the drive system is configured to selectively move the upper connector into spaced relation with the lower connector.

11. A ground accessible sign system as claimed in claim 7, wherein in the retracted position, the first and second sets of guide members have a height that is less than or generally equal to the height of the sign.

12. A ground accessible sign system as claimed in claim 7, wherein a wheel is connectable to one of the wall and at least one guide member in each set, wherein the wheel is rotatable against the other one of the wall and at least one guide member during extension and retraction of the sets of guide members, and wherein when each set of guide members is in the extended position, the wheel is spaced from the anchor guide member for stabilizing the sets of guide members.

* * * * *